US006389935B1

(12) United States Patent
Azima et al.

(10) Patent No.: US 6,389,935 B1
(45) Date of Patent: May 21, 2002

(54) ACOUSTIC DISPLAY SCREEN

(75) Inventors: Henry Azima, Cambridge; Martin Colloms, London; Neil Harris, Great Shelford, all of (GB)

(73) Assignee: New Transducers Limited, London (GB)

( * ) Notice: Subject to any disclaimer, the term of this patent is extended or adjusted under 35 U.S.C. 154(b) by 176 days.

(21) Appl. No.: 09/029,056

(22) PCT Filed: Sep. 2, 1996

(86) PCT No.: PCT/GB96/02137

§ 371 Date: Jul. 8, 1998

§ 102(e) Date: Jul. 8, 1998

(87) PCT Pub. No.: WO97/09853

PCT Pub. Date: Mar. 13, 1997

Related U.S. Application Data

(63) Continuation-in-part of application No. 08/707,012, filed on Sep. 3, 1996.

(51) Int. Cl.[7] ..... H04R 25/00

(52) U.S. Cl. ..... 81/388; 381/333; 381/425; 381/431; 381/423

(58) Field of Search ..... 381/176, 81, 338, 381/190, 24, 345, 162, 361, 373, 385, 387, 398, 425, 428; 358/247, 60, 838, 335; 181/169, 171

(56) References Cited

U.S. PATENT DOCUMENTS

| | | | | | |
|---|---|---|---|---|---|
| 1,603,841 | A | * | 4/1926 | Coe | 381/428 |
| 1,778,084 | A | * | 10/1930 | Nevin | 381/90 |
| 3,862,366 | A | * | 1/1975 | Huszty et al. | 179/1 E |
| 4,400,723 | A | * | 8/1983 | Fanizza et al. | 358/60 |
| 4,404,427 | A | * | 9/1983 | Blackmer | 179/1 VI |
| 4,467,235 | A | * | 8/1984 | DeWames | 310/313 |
| 4,751,419 | A | * | 6/1988 | Takahata | 310/324 |
| 5,007,707 | A | | 4/1991 | Bertagni | |
| 5,025,474 | A | * | 6/1991 | Tanaka et al. | 381/90 |
| 5,214,514 | A | * | 5/1993 | Haberkern | 358/335 |
| 5,638,456 | A | | 6/1997 | Conley et al. | |
| 5,675,426 | A | * | 10/1997 | Meisner et al. | 358/838 |
| 5,748,758 | A | * | 5/1998 | Menasco et al. | 381/176 |
| 5,793,877 | A | * | 8/1998 | Tagg | 381/156 |

FOREIGN PATENT DOCUMENTS

| | | | |
|---|---|---|---|
| GB | 2010637 | A | * 11/1978 |
| GB | 2246684 | A | * 4/1990 |

* cited by examiner

*Primary Examiner*—Huyen Le
*Assistant Examiner*—Dionne N. Harvey
(74) *Attorney, Agent, or Firm*—Foley & Lardner

(57) ABSTRACT

A display screen (32), e.g., a projection screen comprising a panel having a light reflective surface, characterised in that the screen is a distributed mode acoustic radiator loudspeaker having a transducer (9) mounted wholly and exclusively thereon to vibrate the radiator to cause it to resonate to provide an acoustic output.

12 Claims, 3 Drawing Sheets

ACOUSTIC DISPLAY SCREEN

This application is a continuation-in-part of application Ser. No. 08/707,012, filed Sep. 3, 1996.

TECHNICAL FIELD

The invention relates to display screens and more particularly, but not exclusively, to projection screens.

BACKGROUND ART

It is known from GB-A-2262861 to suggest a panel-form loudspeaker comprising:a resonant multi-mode radiator element being a unitary sandwich panel formed of two skins of material with a spacing core of transverse cellular construction, wherein the panel is such as to have ratio of bending stiffness (B), in all orientations, to the cube power of panel mass per unit surface area ($\mu$) of at least 10;

a mounting means which supports the panel or attaches to it a supporting body, in a free undamped manner;

and an electromechanical drive means coupled to the panel which serves to excite a multi-modal resonance in the radiator panel in response to an electrical input within a working frequency band for the loudspeaker.

U.S. Pat. No. 5,025,474 of MATSUSHITA discloses a projection screen/loudspeaker combination in which the loudspeaker comprises a box-like enclosure formed with ports so that the loudspeaker operates as a bass-reflex speaker to enhance its low frequency performance.

U.S. Pat. No. 3,247,925 of WARNAKA discloses what purports to be a low frequency resonant panel loudspeaker mounted in a chassis and excited by an electromechanical transducer mounted on the chassis.

DISCLOSURE OF INVENTION

Embodiments of the present invention use members of nature, structure and configuration achievable generally and/or specifically by implementing teachings of our co-pending application Ser. No. 08/707,012. Such members thus have capability to sustain and propagate input vibrational energy by bending waves in operative area(s) extending transversely of thickness often but not necessarily to edges of the member(s); are configured with or without anisotropy of bending stiffness to have resonant mode vibration components distributed over said area(s) beneficially for acoustic coupling with ambient air; and have predetermined preferential locations or sites within said area for transducer means, particularly operationally active or moving part(s) thereof effective in relation to acoustic vibrational activity in said area(s) and signals, usually electrical, corresponding to acoustic content of such vibrational activity. Uses are envisaged in co-pending application Ser. No. 08/707,012 for such members as or in "passive" acoustic devices without transducer means, such as for reverberation or for acoustic filtering or for acoustically "voicing" a space or room; and as or in "active" acoustic devices with transducer means, such as in a remarkably wide range of sources of sound or loudspeakers when supplied with input signals to be converted to said sound, or in such as microphones when exposed to sound to be converted into other signals.

This invention is particularly concerned with display screens incorporating acoustic devices e.g. in the form of loudspeakers.

Members as above are herein called distributed mode acoustic radiators and are intended to be characterised as in the above co-pending patent application and/or otherwise as specifically provided herein.

The invention is a display screen comprising a panel having a light reflective or light emitting surface, characterised in that the screen comprises a member having capability to sustain and propagate input vibrational energy by bending waves in at least one operative area extending transversely of thickness to have resonant mode vibration components distributed over said at least one area and have predetermined preferential locations or sites within said area for transducer means and having a transducer mounted wholly and exclusively on said member at one of said locations or sites to vibrate the member to cause it to resonate forming an acoustic radiator which provides an acoustic output when resonating. The radiator may comprise a stiff lightweight panel having a cellular core sandwiched between a pair of high modulus skins. The cellular core may be of honeycomb aluminium foil. The skins may be of fibre reinforced plastics. The display screen may comprise a frame surrounding the panel. A resilient suspension may mount the panel in the frame. Panel-form loudspeakers may be attached to opposite sides of the frame to provide left and right hand channel information. The left and right hand loudspeakers may be hinged on the frame to be foldable against the radiator (2) for storage. The left and right hand loudspeakers may each comprise a member having capability to sustain and propagate input vibrational energy by bending waves in at least one operative area extending transversely of thickness to have resonant mode vibration components distributed over said at least one area and have predetermined preferential locations or sites within said area for transducer means and having a transducer mounted wholly and exclusively on said member at one of said locations or sites to vibrate the member to cause it to resonate forming an acoustic radiator which provides an acoustic output when resonating. The screen may be a projection screen.

From another aspect the invention is audio visual apparatus characterised by a projection screen. The audio visual apparatus may comprise at least one rear channel loudspeaker comprising a member having capability to sustain and propagate input vibrational energy by bending waves in at least one operative area extending transversely of thickness to have resonant mode vibration components distributed over said at least one area and have predetermined preferential locations or sites within said area for transducer means and having a transducer mounted wholly and exclusively on said member at one of said locations or sites to vibrate the member to cause it to resonate forming an acoustic radiator which provides an acoustic output when resonating.

BRIEF DESCRIPTION OF DRAWINGS

The invention is diagrammatically illustrated, by way of example, in the accompanying drawings, in which.

BEST MODES FOR CARRYING OUT THE INVENTION

Figure 1:
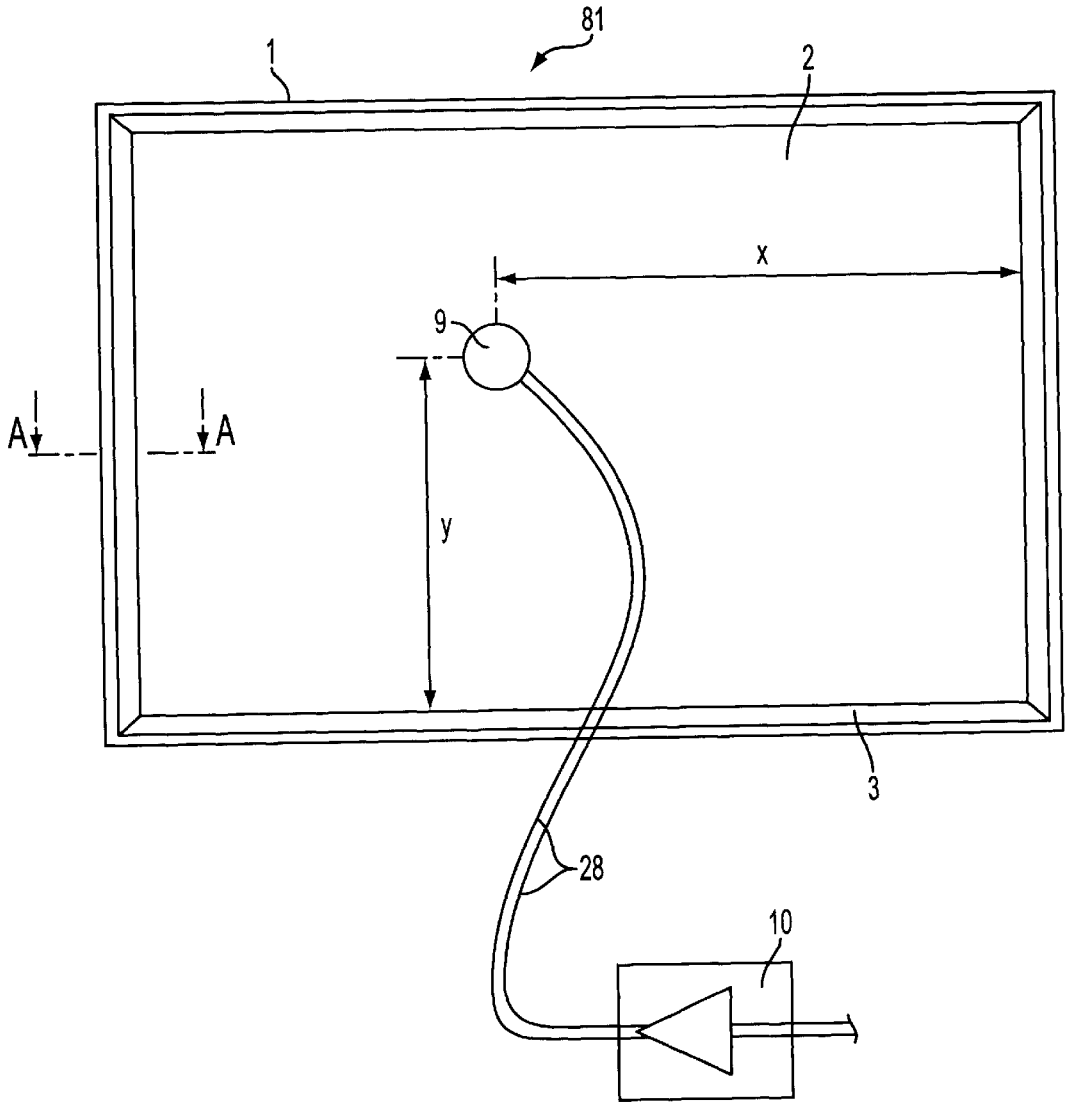
FIG. 1 is a diagram showing a distributed-mode loudspeaker as described and claimed in our co-pending application Ser. No. 08/707,012.

Referring to FIG. 1 of the drawings, there is shown a panel-form loudspeaker (81) of the kind described and claimed in our co-pending application Ser. No. 08/707,012 comprising a rectangular frame (1) carrying a resilient suspension (3) round its inner periphery which supports a distributed mode sound radiating panel (2). A transducer (9) e.g. as described in detail with reference to our co-pending application Ser. Nos. 09/011,773, 09/011,770, and 09/011,831, is mounted wholly and exclusively on or in the panel (2) at a predetermined location defined by dimensions x and v, the position of which location is calculated as described in our co-pending application Ser. No. 08/707,012, to launch bending waves into the panel to cause the panel to resonate to radiate an acoustic output.

The transducer (9) is driven by a signal amplifier (10), e.g. an audio amplifier, connected to the transducer by conductors (28). Amplifier loading and power requirements can be entirely normal, similar to conventional cone type speakers, sensitivity being of the order of 86–88 dB/watt under room loaded conditions. Amplifier load impedance is largely resistive at 6 ohms, power handling 20–80 watts. Where the panel core and/or skins are of metal, they may be made to act as a heat sink for the transducer to remove heat from the motor coil of the transducer and thus improve power handling.

Figure 2A:
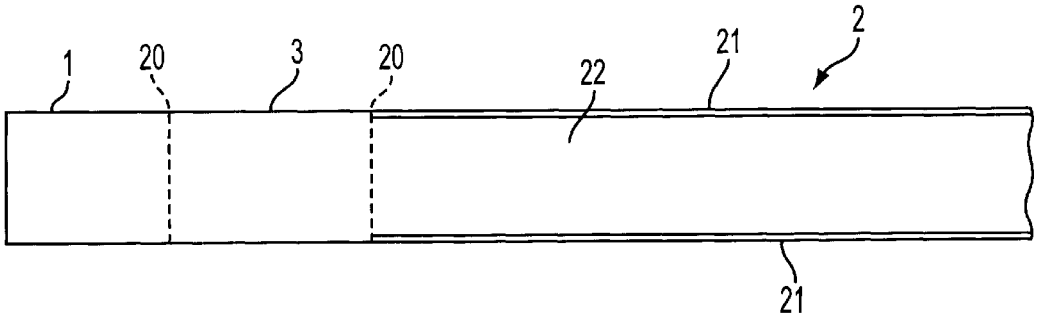
FIG. 2*a* is a partial section on the line A—A of FIG. 1.
Figure 2B:
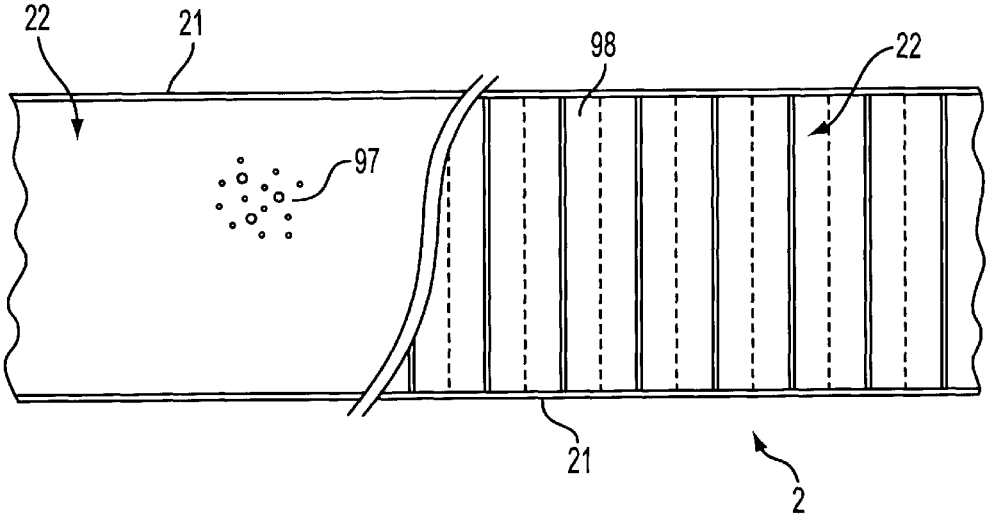
FIG. 2*b* is an enlarged cross-section through a distributed mode radiator of the kind shown in FIG. 2*a* and showing two alternative constructions.

FIGS. 2*a* and 2*b* are partial typical cross-sections through the loudspeaker (81) of FIG. 1. FIG. 2*a* shows that the frame (1), surround (3) and panel (2) are connected together by respective adhesive-bonded joints (20). Suitable materials for the frame include lightweight framing, e.g. picture framing of extruded metal e.g. aluminium alloy or plastics. Suitable surround materials include resilient materials such as foam rubber and foam plastics. Suitable adhesives for the joints (20) include epoxy, acrylic and cyano-acrylate etc. adhesives.

FIG. 2*b* illustrates, to an enlarged scale, that the panel (2) is a rigid lightweight panel having a core (22) e.g. of a rigid plastics foam (97) e.g. cross linked polyvinylchloride or a cellular matrix (98) i.e. a honeycomb matrix of metal foil, plastics or the like, with the cells extending transversely to the plane of the panel, and enclosed by opposed skins (21) e.g. of paper, card, plastics or metal foil or sheet. Where the skins are of plastics, they may be reinforced with fibres e.g. of carbon, glass, Kevlar (RTM) or the like in a manner known per se to increase their modulus.

Envisaged skin layer materials and reinforcements thus include carbon, glass, Kevlar (RTM), Nomex (RTM) i.e. aramid etc. fibres in various lays and weaves, as well as paper, bonded paper laminates, melamine, and various synthetic plastics films of high modulus, such as Mylar (RTM), Kaptan (RTM), polycarbonate, phenolic, polyester or related plastics, and fibre reinforced plastics, etc. and metal sheet or foil. Investigation of the Vectra grade of liquid crystal polymer thermoplastics shows that they may be useful for the injection moulding of ultra thin skins or shells of smaller size, say up to around 30 cm diameter. This material self forms an orientated crystal structure in the direction of injection, a preferred orientation for the good propagation of treble energy from the driving point to the panel perimeter.

Additional such moulding for this and other thermoplastics allows for the mould tooling to carry location and registration features such as grooves or rings for the accurate location of transducer parts e.g. the motor coil, and the magnet suspension. Additionally, with some weaker core materials it is calculated that it would be advantageous to increase the skin thickness locally e.g. in an area or annulus up to 150% of the transducer diameter, to reinforce that area and beneficially couple vibration energy into the panel. High frequency response will be improved with the softer foam materials by this means.

Envisaged core layer materials include fabricated honeycombs or corrugations of aluminium alloy sheet or foil, or Kevlar (RTM), Nomex (RTM), plain or bonded papers, and various synthetic plastics films, as well as expanded or foamed plastics or pulp materials, even aerogel metals if of suitably low density. Some suitable core layer materials effectively exhibit usable self-skinning in their manufacture and/or otherwise have enough inherent stiffness for use without lamination between skin layers. A high performance cellular core material is known under the trade name 'Rohacell' which may be suitable as a radiator panel and which is without skins. In practical terms, the aim is for an overall lightness and stiffness suited to a particular purpose, specifically including optimising contributions from core and skin layers and transitions between them.

Several of the preferred formulations for the panel employ metal and metal alloy skins, or alternatively a carbon fibre reinforcement. Both of these, and also designs with an alloy Aerogel or metal honeycomb core, will have substantial radio frequency screening properties which should be important in several EMC applications. Conventional panel or cone type speakers have no inherent EMC screening capability.

In addition the preferred form of piezo and electro dynamic transducers have negligible electromagnetic radiation or stray magnetic fields. Conventional speakers have a large magnetic field, up to 1 metre distant unless specific compensation counter measures are taken.

Where it is important to maintain the screening in an application, electrical connection can be made to the conductive parts of an appropriate DML panel or an electrically conductive foam or similar interface may be used for the edge mounting.

The suspension (3) may damp the edges of the panel (2) to prevent excessive edge movement of the panel. Additionally or alternatively, further damping may be applied, e.g. as patches, bonded to the panel in selected positions to damp excessive movement to distribute resonance equally over the panel. The patches may be of bitumen-based material, as commonly used in conventional loudspeaker enclosures or may be of a resilient or rigid polymeric sheet material. Some materials, notably paper and card, and some cores may be self-damping. Where desired, the damping may be increased in the construction of the panels by employing resiliently setting, rather than rigid setting adhesives.

Effective said selective damping includes specific application to the panel including its sheet material of means permanently associated therewith. Edges and corners can be particularly significant for dominant and less dispersed low frequency vibration modes of panels hereof. Edge-wise fixing of damping means can usefully lead to a panel with its said sheet material fully framed, though their corners can often be relatively free, say for desired extension to lower frequency operation. Attachment can be by adhesive or self-adhesive materials. Other forms of useful damping, particularly in terms of more subtle effects and/or mid- and higher frequencies can be by way of suitable mass or masses affixed to the sheet material at predetermined effective medial localised positions of said area.

An acoustic panel as described above is bidirectional. The sound energy from the back is not strongly phase related to that from the front. Consequently there is the benefit of overall summation of acoustic power in the room, sound energy of uniform frequency distribution, reduced reflective and standing wave effects and with the advantage of superior reproduction of the natural space and ambience in the reproduced sound recordings.

While the radiation from the acoustic panel is largely non-directional, the percentage of phase related information increases off axis. For improved focus for the phantom stereo image, placement of the speakers, like pictures, at the usual standing person height, confers the benefit of a moderate off-axis placement for the normally seated listener optimising the stereo effect. Likewise the triangular left/right geometry with respect to the listener provides a further angular component. Good stereo is thus obtainable.

There is a further advantage for a group of listeners compared with conventional speaker reproduction. The intrinsically dispersed nature of acoustic panel sound radiation gives it a sound volume which does not obey the inverse square law for distance for an equivalent point source. Because the intensity fall-off with distance is much less than predicted by inverse square law then consequently for off-centre and poorly placed listeners the intensity field for the panel speaker promotes a superior stereo effect compared to conventional speakers. This is because the off-centre placed listener does not suffer the doubled problem due to proximity to the nearer speaker; firstly the excessive increase in loudness from the nearer speaker, and then the corresponding decrease in loudness from the further loudspeaker.

There is also the advantage of a flat, lightweight panel-form speaker, visually attractive, of good sound quality and requiring only one transducer and no crossover for a full range sound from each panel diaphragm.

Figure 3:
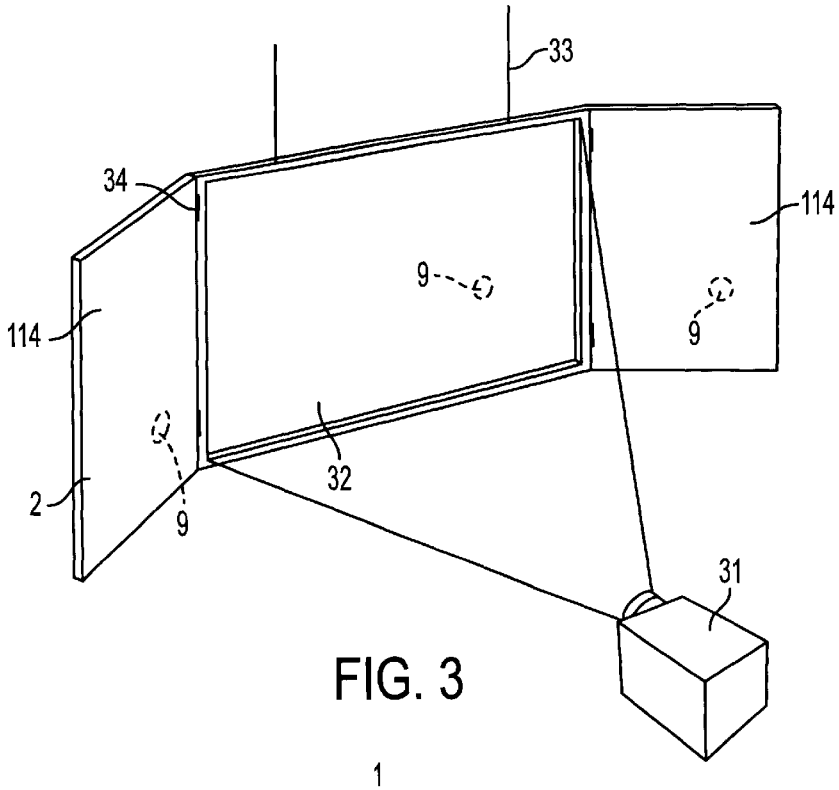
FIG. 3 is a perspective diagram of an embodiment of projection screen according to the present invention.

FIG. 3 illustrates a multi-media audio-visual system comprising a moving picture projector (31) arranged to project an image onto a projection screen formed by a loudspeaker panel (32) of the kind shown in FIGS. 1 and 2.

The loudspeaker/projection screen (32) comprises a panel (2) having aluminium or carbon fibre reinforced skins (21) sandwiching a honeycomb core (22) of aluminium foil. The composite may be secured together using any epoxy adhesive. For a screen panel size of 1.22×1.38 m, the thickness of the aluminium skins may be 300 microns. The core thickness may be 11 mm and the cell size of honeycomb may be 9.5 mm. Such a panel is stiff, of low density, high modulus and is isotropic.

A pair of smaller subsidiary loudspeakers (114) of the kind described in FIGS. 1 and 2 are hinged on opposite sides of the centre channel loudspeaker panel (32) by means of hinges (34) whereby the subsidiary panels can be hinged against the primary panel (32) when not in use and can be moved into the position as illustrated for use. The subsidiary panels (114) are arranged to receive and radiate respective left and right hand channel information, e.g. for stereo operation.

The subsidiary loudspeakers (114) may comprise panels (2) having skins (21) of aluminium foil, or carbon fibre or glass fibre reinforced plastics. A decorative film, e.g. of polyester may be applied over one or both of the skins. The core (22) of the panels (114) may be of aluminium foil, e.g. in a honeycomb cell arrangement, or may be of paper cells. Where paper is employed it may be impregnated with a plastics material such as a phenolic compound to improve the stiffness of the paper. The cell size may be in the range 3 to 6 mm and the core thickness may be of the order of 3 to 10 mm. Where the skins are of aluminium foil they may be 25 to 100 microns in thickness. An epoxy adhesive may be used to assemble the panel.

Stereo, i.e. two channel sound reproduction, involves the creation of sound stage illusion containing the properties of source location, perspective and the ambience of the original recording. Stereo with conventional speakers is strong on aspects of phantom source location and in some cases perspective, but is weaker in respect of the expression of natural space and ambience. This is because the near point source nature of conventional pistonic speakers makes it easy aurally to identify their physical location, which in conflict with the desire for overall stereo image localisation.

It is often said that as reproducing devices the loudspeakers should disappear into the sound stage illusion. Part of the problem lies in the relatively narrow forward radiating directivity of conventional speakers. In addition, the sound balance to the sides and rear of the enclosure, sound which strongly drives the reverberant sound field in the room, is coloured and unbalanced with significant variations in frequency response. This detracts from the sense of natural acoustic space and ambience.

The embodiment of FIG. 3 employs a pair of acoustic panel speakers for left and right channels which are set in complex vibration over the whole surface over a wide frequency range typically 100 Hz to 20 kHz.

The primary loudspeaker panel (32) is shown suspended on suspension means (33) but alternatively the panel may be supported e.g. on a floor stand.

Figure 5:
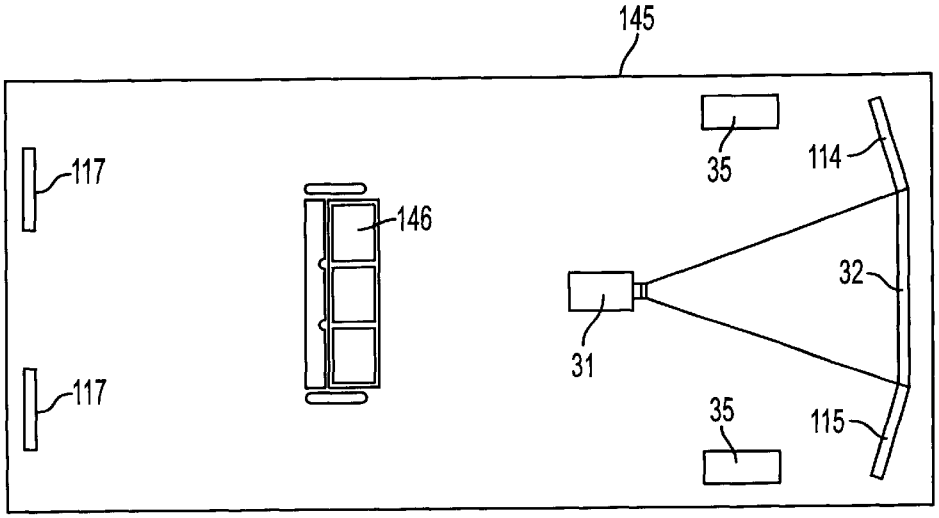
FIG. 5 is a plan view of a room incorporating the projection screen of FIG. 3.

FIG. 5 shows how the projection apparatus of the present invention may be arranged in a room (145) equipped with seating (146). The apparatus has a projector (31) projecting an image onto the screen (32) and also includes a pair of subwoofers (35), which may be of conventional construction, at the sides of the room to improve bass audio extension and a pair of rear effect loudspeakers (117) i.e. so-called ambience speakers, at the rear of the room. Suitably the rear speakers (117) are also of the kind shown in FIGS. 1 and 2 in view of their wide and even sound dispersion characteristics. The rear effect loudspeakers may be of the same construction as the subsidiary loudspeakers (114).

A panel loudspeaker according to FIGS. 1 and 2 has remarkable non directional properties. For acoustic reproduction of ambience channels of a sound system, the energy must be widely distributed, ideally from non directional sources. It is important that the sound source is not well localised otherwise the perception of a large ambient space, the simulated acoustic region behind the listener, is unsatisfactory.

Hitherto conventional directional and/or small source speakers, generally moving coil types, are used for ambience reproduction. Due to the intensity phenomenon of aural perception, audience members seated closer to a nearby ambience speaker find their perception strongly localised on that speaker greatly impairing the ambience effect and their whole appreciation of the multichannel sound field. The localisation may be so powerful that aural attention is drawn away from the primary front stage sound channels this working in conjunction with the Haas effect which reinforces the localisation to proximate sources.

An ambience reproducing system built with one or more loudspeakers according to FIGS. 1 and 2 deliver a large sound field or near uniform intensity which has deliberately poor localisation. A large audience may be handled, even with some persons in close proximity (as near as 0.5 m) to the panel loudspeakers without any significant localisation of the immediate reproducing channel and with the vital property of an unimpaired aural perception of the important front channels. Greatly improved realism is achieved for the multi-channel sound reproducing system as a whole as a result of the desirable radiating characteristics of the acoustic panel sound reproducer.

The ambience loudspeakers may if desired be suspended on wires and disguised, by the application of a suitable image to the panel (2) to resemble pictures.

Figure 4:
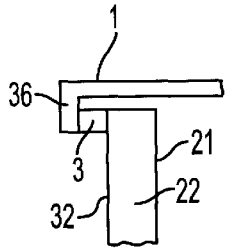
FIG. 4 is a partial view of a detail of the screen of FIG. 3.

FIG. 4 shows how the frames (1) of the projection/loudspeaker panel may be formed with a return lip (36) whereby the suspension (3) can be concealed. The frames of the subsidiary loudspeakers (114) and the ambience loudspeakers (117) may be similarly formed.

INDUSTRIAL APPLICABILITY

An acoustic panel build to sufficient size to serve as a projection screen for still, film and video images, is thus simultaneously a sound reproducer for example for the centre or dialogue channel of home theatre. Uniquely, acoustic panels according to the present invention of good size, say over 0.6 m wide, provide very good sound coverage for audiences. Working demonstrations have shown high intelligibility and sound clarity over the whole audience region with a major advantage that persons nearest to the screen do not suffer blasting from excessive proximate sound levels, invariably a flaw of conventional direct radiating cone based speakers.

There is a second and unique aspect of a projection screen of the invention. With conventional centre channel speakers the ear is easily capable of locating the acoustic centre of the speaker. All sounds appear to come from this concentrated small source, detracting from the sense of realism. With the acoustic panel, its uniquely non-directional radiation property means that the sound appears to come from the general acoustic region of the screen but not from one isolated point. When the image is combined with sound on the panel, there is a powerful synaesthetic effect. Here the desirable lack of specific sound source localisation allows the ear/brain sensing combination freely to associate an imagined, virtual and approximate location for the sound sources, synchronised with the locations presented by the visual image on the acoustic surface.

With well recorded dialogue sections, not only does the virtual acoustic image appear to track the visual image, it can also convey the information needed for the perception to depth and perspective. The quality of audience involvement in the cinematic experience is substantially enhanced.

What is claimed is:

1. A display screen adapted to operate as a loudspeaker, comprising:

a panel having a light reflecting or light emitting surface, and selected values of certain physical parameters which enable the panel to sustain and propagate input vibrational energy in a predetermined frequency range by a plurality of resonant bending wave modes in at least one operative area extending transversely of thickness such that the frequencies of the resonant bending wave modes along at least two conceptual axes of the operative area are interleaved and spread so that there are substantially minimal clusterings and disparities of spacings of said frequencies, the panel when resonating having at least one site at which the number of vibrationally active resonance anti-nodes is relatively high; and a transducer coupled to the panel at one of said sites on the panel, the transducer being capable of vibrating the panel in the predetermined frequency range to couple to and excite the resonant bending wave modes in the panel and cause the panel to resonate and produce an acoustic output.

2. A display screen according to claim 1, wherein the panel (2) is a stiff lightweight panel having a cellular core (22) sandwiched between a pair of high modulus skins (21).

3. A display screen according to claim 2, further comprising a frame (11) surrounding the panel.

4. A display screen according to claim 3, further comprising a resilient suspension (3) mounting the panel in the frame.

5. A display screen according to claim 2, wherein the cellular core (22) is of honeycomb aluminium foil (98).

6. A display screen according to claim 2, wherein the skins (21) are of fibre reinforced plastics.

7. A display screen according to claim 3, further comprising panel-form loudspeakers (114) attached to opposite sides of the frame (1) to provide left and right hand channel information.

8. A display screen according to claim 7, wherein the left and right hand loudspeakers (114) are hinged on the frame (1) to be foldable against the panel (2) for storage.

9. A display screen according to claim 7, wherein each of the left and right loudspeakers comprises:

a panel having selected values of certain physical parameters which enable the panel to sustain and propagate input vibrational energy in a predetermined frequency range by a plurality of resonant bending wave modes in at least one operative area extending transversely of thickness such that the frequencies of the resonant bending wave modes along at least two conceptual axes of the operative area are interleaved and spread so that there are substantially minimal clusterings and disparities of spacings of said frequencies, the panel when resonating having at least one site at which the number of vibrationally active resonance anti-nodes is relatively high; and a transducer coupled to the panel at one of said sites on the panel, the transducer being capable of vibrating the panel in the predetermined frequency range to couple to and excite the resonant bending wave modes in the panel and cause the panel to resonate and produce an acoustic output.

10. A display screen according to claim 1, wherein the screen (2) is a projection screen.

11. Audio visual apparatus comprising a projection screen (32) as claimed in claim 10.

12. Audio-visual apparatus according to claim 11, further comprising at least one rear channel loudspeaker comprising:

a panel having selected values of certain physical parameters which enable the panel to sustain and propagate input vibrational energy in a predetermined frequency range by a plurality of resonant bending wave modes in at least one operative area extending transversely of thickness such that the frequencies of the resonant bending wave modes along at least two conceptual axes of the operative area are interleaved and spread so that there are substantially minimal clusterings and disparities of spacings of said frequencies, the panel when resonating having at least one site at which the number of vibrationally active resonance anti-nodes is relatively high; and a transducer coupled to the panel at one of said sites on the panel, the transducer being capable of vibrating the panel in the predetermined frequency range to couple to and excite the resonant bending wave modes in the panel and cause the panel to resonate and produce an acoustic output.

* * * * *